United States Patent [19]

Houch

[11] 4,153,139

[45] May 8, 1979

[54] NON ADJUSTABLE CLIMBER

[76] Inventor: Melvin J. Houch, 10823 75th St., Kenosha, Wis. 53140

[21] Appl. No.: 897,856

[22] Filed: Apr. 19, 1978

[51] Int. Cl.[2] ..... A63B 27/00

[52] U.S. Cl. ..... 182/221; 182/134

[58] Field of Search ..... 182/221, 133, 134

[56] References Cited

U.S. PATENT DOCUMENTS

| | | | |
|---|---|---|---|
| 237,275 | 2/1881 | Hill | 182/221 |
| 2,391,810 | 12/1945 | Webber | 182/221 |
| 2,602,936 | 7/1952 | Erickson | 248/217.3 |
| 2,870,947 | 1/1959 | Hendry | 182/221 |
| 2,917,263 | 12/1959 | Appleton | 248/217.3 |

*Primary Examiner*—Reinaldo P. Machado

*Attorney, Agent, or Firm*—Andrus, Sceales, Starke & Sawall

[57] ABSTRACT

A gaff of generally chanular shape has its free edges welded to the vertical leg bar of the climber and its lower end is tapered to a point with the free edges sharp to facilitate ready penetration of the pole or tree. The bar of the climber is of high strength strip metal stock with a pair of spaced parallel ribs extending longitudinally on either side of the gaff and continues beneath the foot of the wearer to the outer upward end portion of the bar.

4 Claims, 6 Drawing Figures

Fig. 1
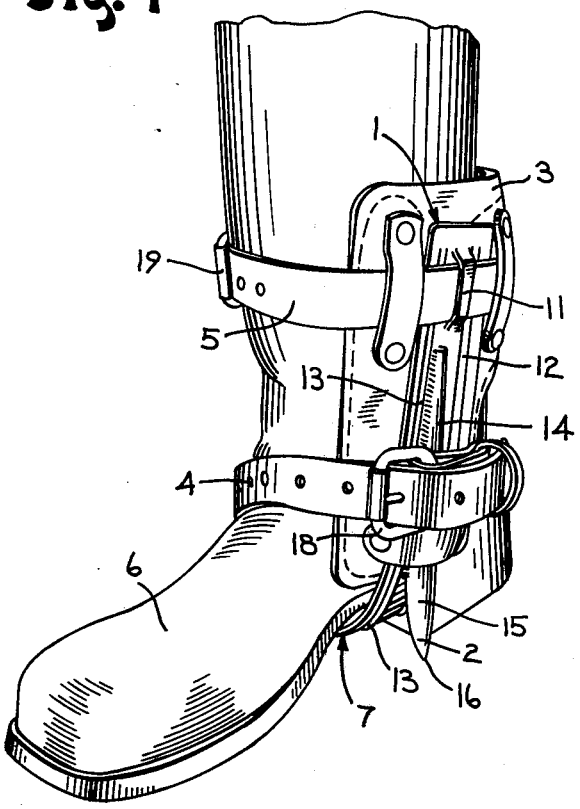
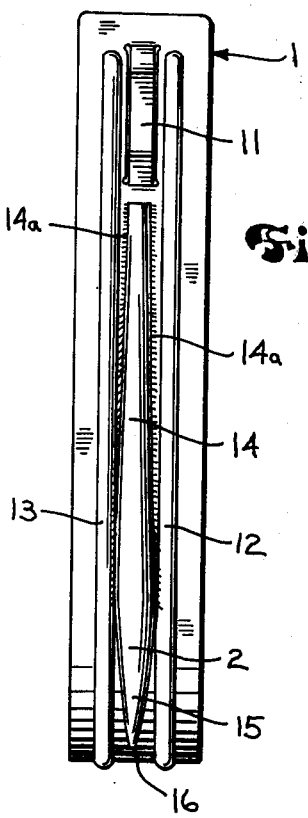
Fig. 2
Fig. 3
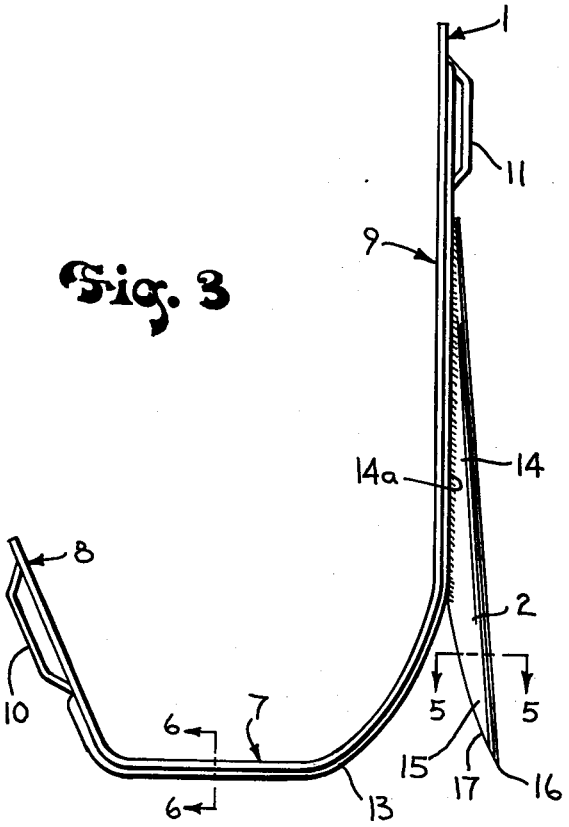
Fig. 4
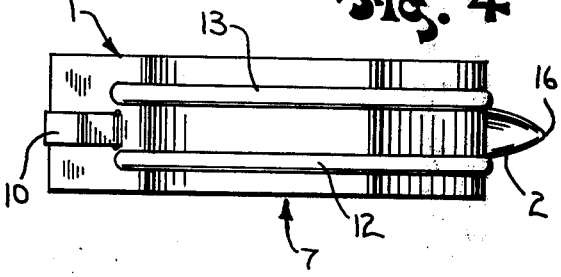
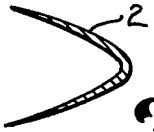
Fig. 5
Fig. 6
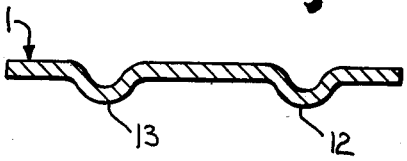

NON ADJUSTABLE CLIMBER

BACKGROUND OF THE INVENTION

This invention relates to a climber.

The art is well worked and replete with various proposed detailed features of construction said to improve some desired objective.

For instance, lightness of weight has always been a desired objective in the construction of climbers. U.S. Pat. No. 938,905 issued Nov. 2, 1909 illustrates an early solution to this objective. However, the construction it illustrates did not protect the ankle of the wearer and the more practical art has employed a vertical bar extending to above the ankle and strapped to the fore-leg of the wearer. The development of this type of climber is well exemplified in U.S. Pat. No. 2,391,810 of Dec. 24, 1945; U.S. Pat. No. 2,604,250 of July 22, 1952 and U.S. Pat. No. 3,867,998 of Feb. 25, 1975.

In all of these as well as in the present day commercial art the gaff employed has been in the form of a solid metal spike or spear. Such spikes are heavy and generally sufficiently short to encounter substantial resistance to penetration of the pole or tree being climbed. This results in fatigue of the wearer.

SUMMARY OF THE INVENTION

In carrying out the present invention, the gaff employed is of hollow chanular construction, generally of V-shaped cross section with the open side facing the boot of the wearer.

The upper end of the gaff is tapered gradually to a smaller width and depth with the free edges welded to the face of the vertical bar of the climber.

The lower end of the gaff continues the angular direction of the outer back portion downwardly to a point with the sides of the gaff tapered from the lower-most weld position outwardly to the point.

The lower edges of the gaff thus provided are tapered more or less to a cutting edge so that the gaff more readily penetrates a pole or tree with a cutting action as distinguished from the expansion forces required in penetration by a spike. Such construction has been found very desirable in substantially reducing damage to the pole or tree commonly found with prior spikes.

The bar to which the gaff is welded is reinforced by the formation therein of a pair of parallel ribs on opposite sides of the long tapered upper end of the gaff and which ribs continue beneath the boot of the wearer and around the bend upwardly on the outside of the boot of the wearer. This type of reinforcement enables the employment of a lighter weight bar.

The tubular construction provided by welding the chanular gaff to the vertical bar of the climber, coupled with the ribs referred to effect a very rigid upper leg for the climber and protects the ankle of the wearer.

BRIEF DESCRIPTION OF THE DRAWING

The accompanying drawing illustrates the best mode presently contemplated of carrying out the invention.

FIG. 1 is a perspective view of the climber as fastened to the boot of a wearer;

FIG. 2 is a side elevation of the vertical bar and gaff;

FIG. 3 is a front elevation of the metal parts shown in FIG. 2;

FIG. 4 is a bottom plan view of the parts shown in FIGS. 2 and 3;

FIG. 5 is an enlarged sectional view of the gaff taken on line 5—5 of FIG. 3; and FIG. 6 is an enlarged sectional view of the climber bar taken on line 6—6 of FIG. 3.

DESCRIPTION OF THE PREFERRED EMBODIMENT

The climber illustrated in the drawing generally comprises a metal bar 1 to which a gaff 2 is welded, and a suitable leather pad 3 and straps 4 and 5 for securing the same to the boot 6 of the wearer.

The bar 1 comprises a high strength metal strip bent to provide a stirrup portion 7 with an outer upper end 8 embracing the outer side of boot 6 and a vertical inner end 9 extending upwardly to above the ankle location of the wearer.

The stirrup portion 7 of bar 1 is adapted to fit beneath the instep of boot 6 of the wearer.

The bar 1 is slit and has a loop 10 formed outwardly therefrom at end 8 for receiving strap 4, and a similar loop 11 slit and formed therefrom at end 9 for receiving strap 5.

Between the loops 10 and 11, the bar 1 is substantially stiffened by the formation therein of two spaced parallel outwardly extending ribs 12 and 13 extending for substantially the length of bar 1 from the area of loop 10 to the area of loop 11 and of a contour illustrated in FIG. 6.

The gaff 2 is formed of a flat metal strip pressed into a chanular cross-sectional shape of generally semi-circular contour for the upper gradually tapered body 14 and of somewhat V contour as illustrated in FIG. 5 for the lower end 15 approaching the point 16.

The gaff 2 is of maximum section at a position between the body 14 and lower end 15 and tapers in sections to a substantially reduced dimension at its upper end as illustrated in FIGS. 2 and 3 and also tapers in section to the point 16 as illustrated in the same FIGS. 2 and 3.

The free edges of the gaff 2 for the full length of the body 14 are welded to the bar 1 in between ribs 12 and 13, as illustrated by weld lines **14*a***.

The body 14 extends substantially from the lower curved portion of the stirrup 7 upwardly nearby to loop 11 and greatly aids in stiffening the vertical leg portion 9 of bar 1.

The tapering of the body 14 as described disposes the point 16 angularly outward as is desirable to enable the wearer to press the point into a pole or tree.

The free edges 17 of the chanular lower end 15 of gaff 2 are preferably made knife edges as shown in FIG. 5 to further facilitate penetration of the gaff into a pole or tree as by cutting action as distinguished from the usual spear or nail action heretofore needed.

The pad 3 is carried by upper strap 5 as shown in FIG. 1 and serves to protect the ankle of the wearer from undue pressures exerted through boot 6 by otherwise direct contact with leg portion 9 of bar 1.

The lower strap 4 extends through loop 10 and around the ankle portion of boot 6 just above the foot, with a suitable buckle 18 for securing the strap and providing for its release.

The upper strap 5 extends through loop 11 and around the leg portion of boot 6 above the ankle of the wearer, with a suitable buckle 19 for securing the strap and providing for its release.

The light weight contruction of the climber and the greater ease and depth of penetration of the gaff into a pole, tree or other object makes the climber particularly suitable for hunters and non-professional climbers who may need to wear climbers for substantial periods of time for emergency or occasional use.

The climber illustrated is particularly safe in its more certain penetration of a pole or tree. The buckle 18 and strap end serves to keep the lower end 15 of the gaff from accidentally engaging the opposite foot in walking or running.

Various modes of carrying out the invention are contemplated as being within the scope of the following claims particularly pointing out and distinctly claiming the subject matter which is regarded as the invention.

I claim:

1. A climber comprising a bar formed of a metal strip bent to provide a stirrup portion for embracing the boot of a wearer and a substantially straight upwardly extending leg portion on the inner side thereof, and a chanular gaff having its free edges welded to said leg portion for nearly the full length of the latter to stiffen the same, the lower end of said gaff extending freely away from said stirrup and being tapered generally to a point directed angularly away from said stirrup with the lower end of the gaff approaching the point having a substantially inverted V cross section for penetration of an object in climbing by a cutting action providing a minimum of injury to the object.

2. The climber of claim 1, in which the opposite end portions of said bar are slit and formed to provide strap receiving loops for securing the climber to the boot of a wearer.

3. The climber of claim 1, in which the upper body portion of said gaff in the region of said free edge welds is gradually tapered upwardly to dispose the gaff and its lower pointed end angularly of the vertical leg portion of the bar.

4. The climber of claim 1, in which the free edges of the lower pointed end portion of said gaff are generally sharp to provide a cutting action during penetration of the pointed end into an object in climbing.

* * * * *